United States Patent [19]

Gelbard

[11] 4,269,035

[45] May 26, 1981

[54] DEFROST CONTROL

[75] Inventor: Robert B. Gelbard, Louisville, Ky.

[73] Assignee: General Electric Company, Louisville, Ky.

[21] Appl. No.: 95,713

[22] Filed: Nov. 19, 1979

[51] Int. Cl.[3] ..... F25D 21/06

[52] U.S. Cl. ..... 62/155; 62/156; 62/515

[58] Field of Search ..... 62/156, 515; 73/349, 73/362.8; 165/39

[56] References Cited

U.S. PATENT DOCUMENTS

| | | | |
|---|---|---|---|
| 3,084,519 | 4/1963 | Hanson et al. | 62/156 X |
| 3,623,334 | 11/1971 | Heidorn | 62/156 X |
| 3,670,807 | 6/1972 | Muller | 165/39 |

*Primary Examiner*—William E. Wayner
*Assistant Examiner*—Harry B. Tanner
*Attorney, Agent, or Firm*—Frank P. Giacalone; Radford M. Reams

[57] ABSTRACT

A defrost control, including a vertically extending evaporator positioned in thermal contact with the back wall of a chamber. The defrost sensor is arranged above the evaporator and within the boundary layer thickness of air in natural convection so that the sensor will terminate the defrost operation relative to the temperature of the evaporator.

4 Claims, 5 Drawing Figures

DEFROST CONTROL

BACKGROUND OF THE INVENTION

In household refrigeration systems wherein air from within a compartment is recirculated over an evaporator, means are usually provided for periodically removing frost from the evaporator surfaces. In some instances, a defrost operation or cycle is initiated by actually detecting the presence of frost while, in other prior art system, a defrost operation is initiated at spaced predetermined time intervals. Typically, the defrost operation consists of deenergizing the system compressor and air circulating fan and the energization of heaters to melt the frost from the evaporator surfaces. The defrost operation may be terminated by sensing a temperature that indicates the absence of frost or in the alternative by allowing the defrost operation to continue for a period of time deemed sufficient to eliminate frost. The present invention relates to means for terminating defrost as soon as practical after the absence of frost is sensed.

In prior art defrost system bi-metal thermostats arranged on the evaporator have been employed to terminate defrost. This metal-to-metal contact with the evaporator allows accurate temperature sensing of the evaporator surfaces and is effective in terminating defrost. While this arrangement did, in fact, provide desirable results in terminating defrost and, more specifically, in deenergizing the heater, it did require careful installation to insure proper thermal contact between the bi-metal sensor and the evaporator surface. Further, since the thermostat is subjected to humidity and melting frost, it must be of the sealed type to prevent possible electrical shock hazards. The sealed type bi-metal thermostats for use in moist or substantially humid environments are expensive relative to the more open types used in environments wherein they do not come into contact with water or excessively humid conditions. Generally, bi-metal thermostats, when employed, are placed in direct thermal contact with a surface to minimize response time.

The present invention employs a bi-metal thermostat that is responsive to evaporator temperature, as sensed from a remote location.

SUMMARY OF THE INVENTION

The present defrost control relates to a refrigeration system and, more particularly, to means for terminating defrost. The system includes a liner having plurality walls defining a chamber, with vertically extending evaporator arranged adjacent one of the walls of the chamber. A wall member is spaced from one wall to define a heat exchanger enclosure having spaced inlet and outlet openings. A fan is provided for causing circulation of air from the chamber through the enclosure inlet and outlets, and back to the chamber.

The evaporator is positioned in abutment with the wall to thermally link the wall with the evaporator frost load. A defrost heater is arranged in the enclosure and is positioned between the lower portion of the evaporator and the inlet opening.

An air sensing control is arranged in the enclosure downstream of the evaporator and includes a sensing surface arranged to be within the boundary layer thickness of air passing through the enclosure in natural convection. A switch responsive to the temperature of the air flow in the boundary layer thickness is effective in terminating the defrost when the air flow passing over the evaporator is at a predetermined temperature.

An object of the invention is to arrange the evaporator to be in thermal contact with the back wall of the freezer chamber so that it is maintained at substantially evaporator temperatures.

It is a further object of the invention to arrange a bi-metal thermostat within the boundary layer flow of air in natural convection relative to the back wall.

Further objects of the invention will become apparent from the following description of the disclosed embodiment.

DESCRIPTION OF THE PREFERRED EMBODIMENT

Figure 1:
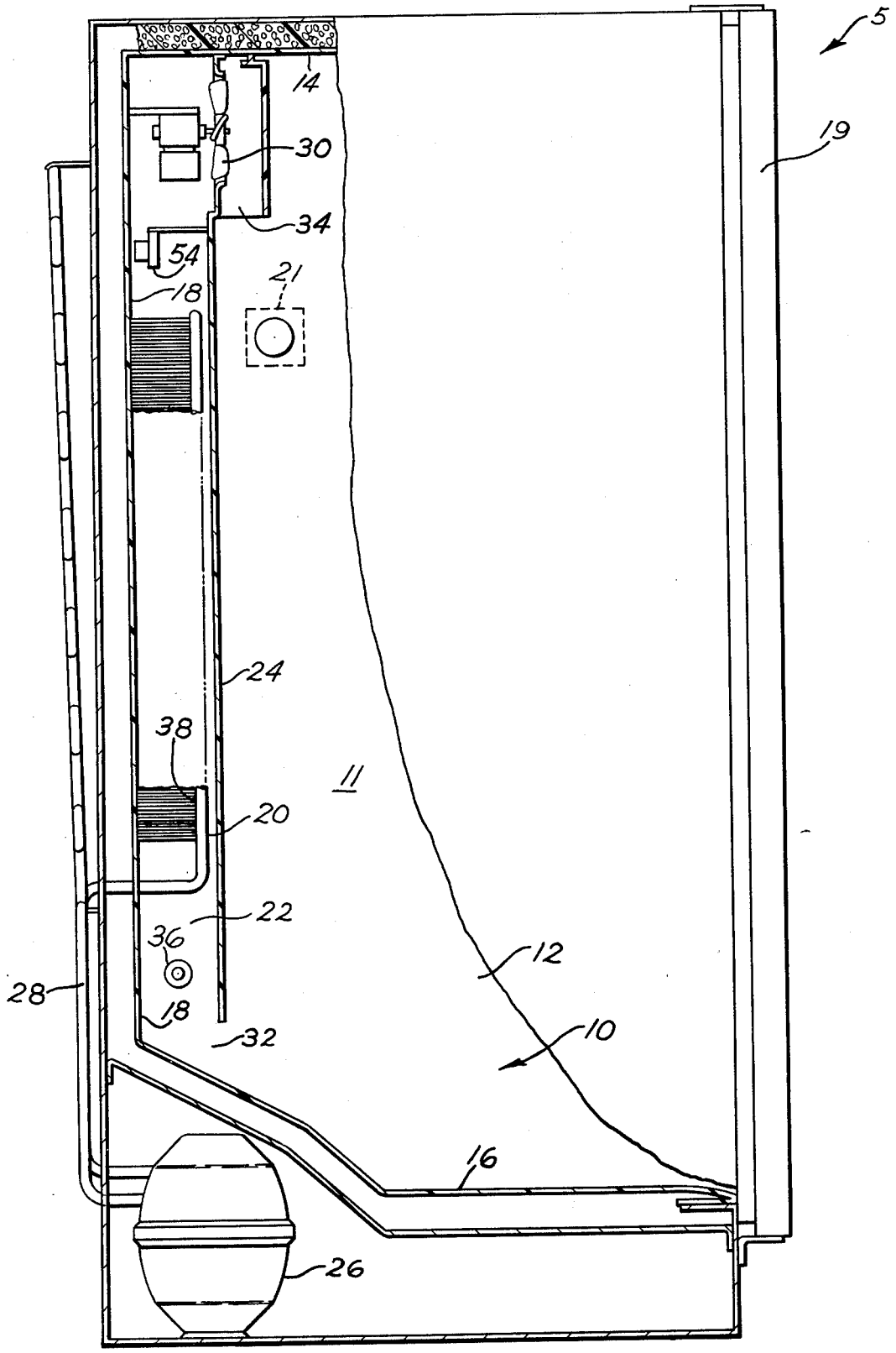
FIG. 1 is a side elevational view, partly in section, illustrating a freezer including the present invention.

The food freezer illustrated in the drawing comprises a freezer 5, including a compartment 10, defined by a liner 11 having side walls 12, upper and lower walls 14 and 16, respectively, and a rear wall 18. The liner 11, defining compartment 10, has a front opening closed by a door 19. The compartment 10 is maintained at subfreezing temperatures, under control of a thermostat 21, by a circulating compartment air over an evaporator 20. The evaporator 20 extends for a substantial vertical distance along the rear wall 18 and is positioned in a vertically-oriented chamber 22. The chamber 22 is separated from the compartment 10 by a wall 24 which is spaced from the rear wall 18. The evaporator 20 forms part of a sealed refrigeration system including a compressor 26 and a condenser 28 connected in series. The wall 24 and related structure are designed so that a fan 30 positioned in the upper portion of the chamber 22 draws compartment air through an air inlet passage 32 at the bottom of chamber 22 and discharges air cooled by the evaporator 20 through an outlet passage 34 back into the upper portion of compartment 10. The evaporator 20 is of the type designed to normally operate at below-freezing temperatures with the result that moisture contained in the air moving through the chamber 22 collects on the evaporator surfaces in the form of frost. Periodically, this accumulated frost is removed from the evaporator surfaces by energizing a heater 36 positioned in heating relationship with the evaporator surfaces in a manner to be explained fully hereinafter. Although one heater 36 is shown, it should be noted that, for the purpose of periodically warming the evaporator surfaces to defrosting temperatures, one or more radiant heaters 36 of the type generally disclosed in U.S. Pat. No. 3,280,581-Turner, Oct. 25, 1966, may be positioned in radiant heating relationship with the evaporator. In the illustrated embodiment of the invention, the single heater 36 is positioned below the evaporator in the lower portion of chamber 22.

Typically, the fan 30 and compressor 26 are deenergized when a defrost operation is initiated and, at the same time, the radiant heater 36 is energized so that natural convection is allowed to melt the frost from the evaporator surfaces. The defrost cycle may be initiated either at predetermined spaced time intervals, such as by a timer 52, or when the presence of frost is determined by a suitable sensing device (not shown). Both procedures for initiating defrost are well known to those skilled in the art and the specific manner of initiating the defrost operation does not form a part of the present invention.

Figure 2:
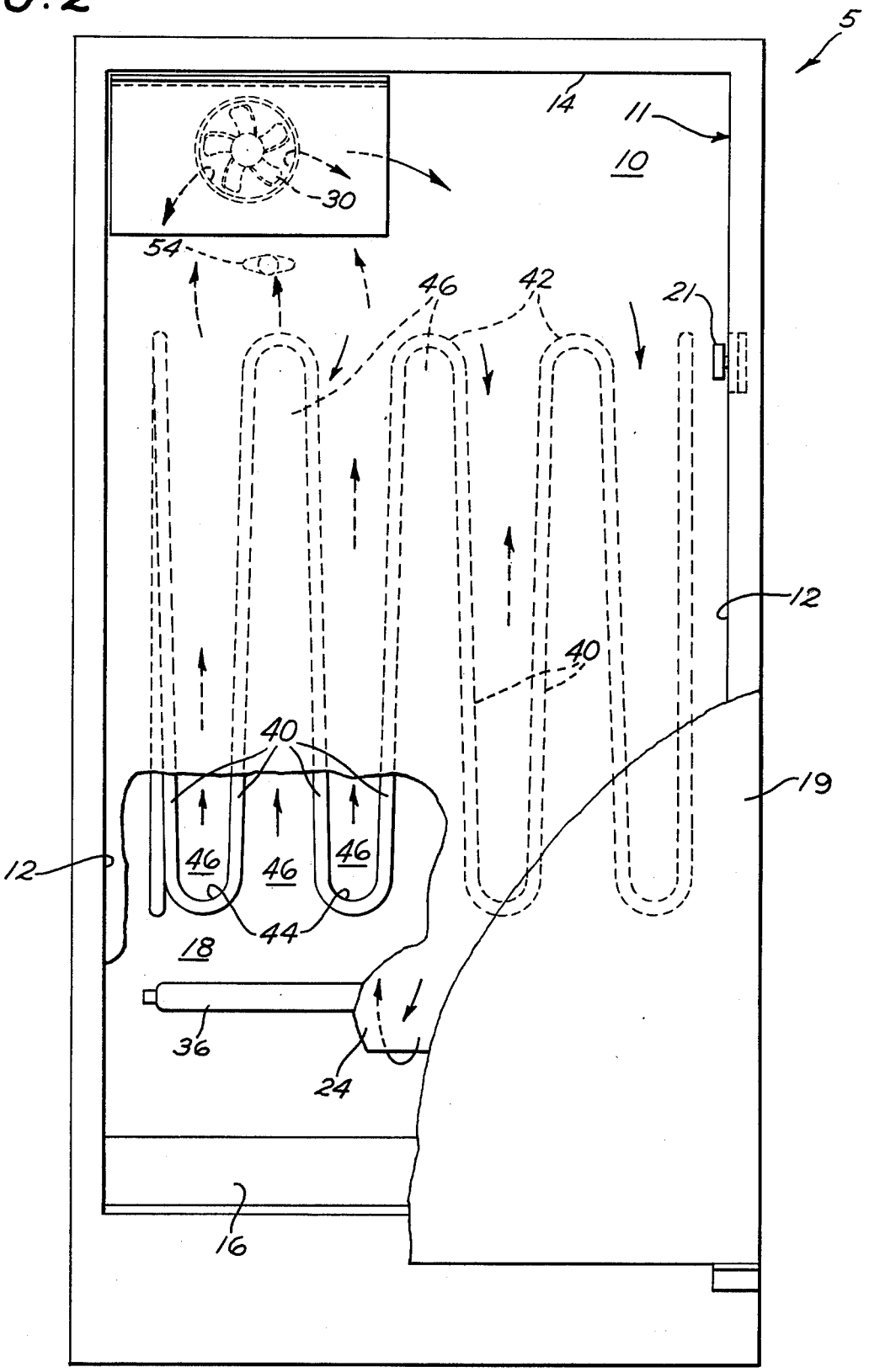
FIG. 2 is a front elevational view of the freezer.

The evaporator 20 employed in conjunction with the present invention comprises finned tubing 38 bent in the form of a serpentine, as shown in FIG. 2. The serpentine configuration provides a plurality of vertical passes 40 in horizontally-spaced arrangement. The vertical passes 40 are connected by integrally formed return bends 42,44 so as to define air passageways 46 extending in the direction of air flow between inlet 32 and outlet 34. The return bends are spaced horizontally so that vertical passes 40 are farther apart relative to adjacent lower bends 44 than they are relative to the upper bends 42. In effect, alternate pairs of the connecting tubes or vertical passes 40 of the evaporator 20 converge toward one another in the direction of air flow. This arrangement enhances the air scrubbing action on the evaporator surfaces by fan 30. Generally, when the passes are arranged parallel, frost tends to build up in certain areas of the evaporator. By the present arrangement, it has been found that frost is distributed evenly throughout the evaporator passes, thereby facilitating accurate sensing of frost by the defrost sensor.

The fins 38 are formed integrally with and extend radially outwardly from the evaporator 20. The fins 38 are arranged so that their distal ends 50 are in firm contact with the rear wall 18 of compartment 10. The evaporator 20 and, more specifically, the fins 38, thermally link the evaporator to the rear wall 18 of the compartment 10 which, in the present embodiment, is metal and has a relatively large mass. In effect, the relative large mass of rear wall 18 of compartment 10 will be maintained at substantially evaporator temperature during operation of the refrigeration system. This cooperative arrangement between the rear wall 18 and the fins 38 effectively links the wall 18 with the evaporator frost load. While in the present embodiment shown the invention is applied to a freezer, it should be understood that the same application can be made to an evaporator employed in refrigerators.

Figure 3:
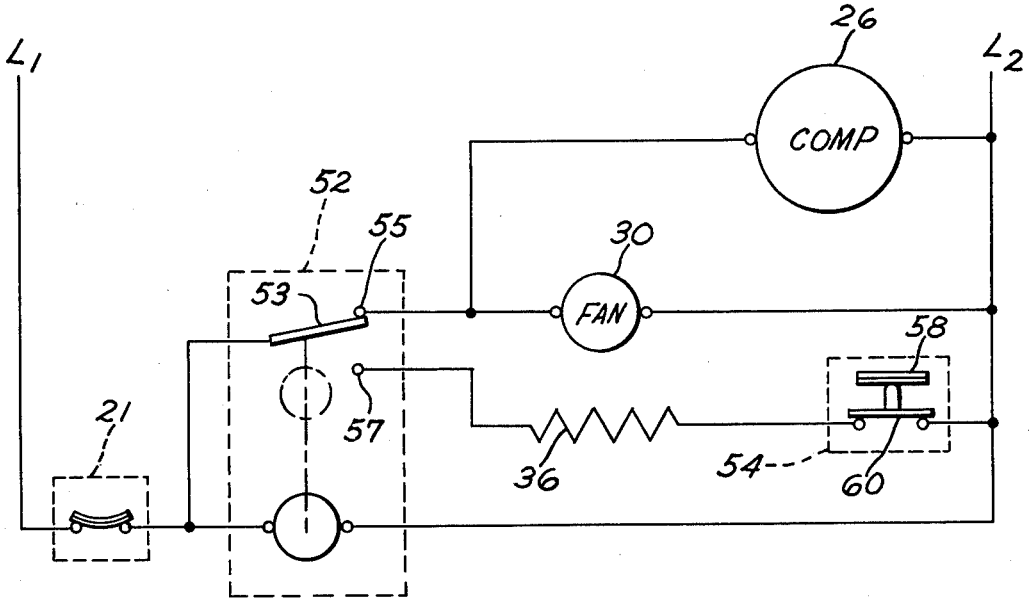
FIG. 3 shows circuit for a defrost system.

As mentioned hereinabove a defrost operation is initiated at spaced time intervals and, in accordance with the present invention, means are provided to terminate the defrost cycle or operation when all of the frost has melted from the evaporator surfaces. In the illustrated embodiment, defrost is initiated at spaced time intervals by the timer 52. Timer 52 periodically operates a switch 53 (FIG. 3) that causes radiant heater 36 to be energized while, at the same time, causing the system compressor 26 and fan 30 to be deenergized in a manner to be fully explained hereinafter.

In the illustrated embodiment of the present invention, a bi-metal sensor 54 is employed for terminating operation of the defrost operation and, more specifically, to deenergize the defrost heater 36. The sensor 54 is positioned in the air flow path in chamber 22 and generally downstream of the evaporator 20.

Figure 4:
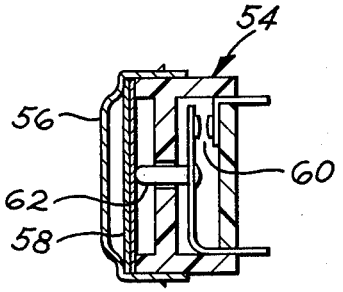
FIG. 4 is a cross-section showing details of the sensor employed in the defrost system.

In the present embodiment the sensor 54, as shown in FIG. 4, is of the bi-metallic type and includes a sensing surface or area 56. The sensing surface is thermally connected to the bi-metal disc 58 in a manner that allows it to flex relative to the sensing surface 56. Typically, the bi-metal disc 58 is operatively associated with a switch 60 which is electrically connected in series with the heater 36. The bi-metal disc 58, through actuator 62, maintains the switch 60 in its closed position at below predetermined frost-producing temperatures and in its open position at above frost-producing temperatures. To function effectively in terminating the defrost operation, the sensor 54 or, more specifically, the bi-metal 58, through sensing surface 61, must be responsive to the temperature that would most likely indicate that frost is no longer present on the evaporator. To this end, the sensing surface 56 is spaced from the rear wall 18 to a distance that places it within the boundary layer thickness of air in natural convection since the fan 30, as mentioned hereinabove, is not operating during the defrost operation. It has been determined that, when the sensing surface was spaced at approximately 0.250 inches from the rear wall 18, it was, in effect, within the boundary layer thickness of air as stated above.

Accordingly, the temperature sensed by the surface 56 and, more particularly, the bi-metal 58 positioned within the boundary layer of wall 18 is substantially the same as the surface temperature of the evaporator. This arrangement of locating the sensing surface 56 of the sensor 54 at a location remote from the evaporator, but within the boundary layer thickness of air in natural convection, assures termination of the defrost operation within the acceptable time range while permitting the use of a sensing unit that does not have its electrical parts sealed against moisture.

Figure 5:
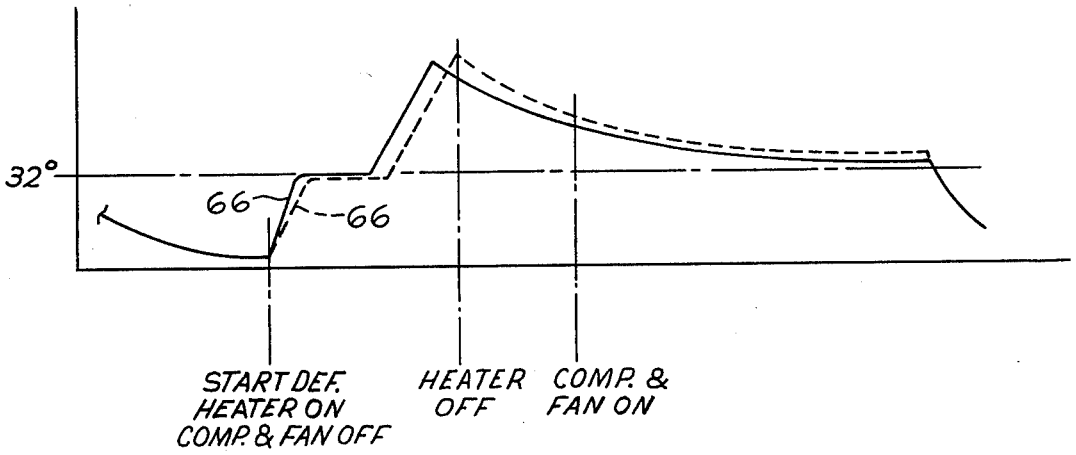
FIG. 5 is a chart showing a comparison of the present defrost operation relative to the prior art.

Referring now to the chart shown in FIG. 5, there are shown two different bi-metal trace lines. Line 66 depicts a properly applied bi-metal typically placed in thermal contact with the evaporator surface and Line 68 depicts the present bi-metal arranged in the boundary layer thickness as stated above. At the start of the defrost cycle or operation, timer 52 causes its switch 53 to move from its position on contact 55 to deenergize the compressor 26 and fan 30 to a position on contact 57 to energize the defrost radiant heater 36. The temperature of the evaporator will rise to approximately 32° F., during which time the frost is melting from the evaporator surfaces. In the absence of frost, the temperature of the evaporator will rise sharply. It is this sudden rise in temperature that causes the bi-metal 58 to snap and terminate the defrost cycle by opening switch 60 and deenergize heater 36 when the surface temperature of the evaporator has risen to about 50° F. With the heater 36 so deenergized, the surface temperature of the evaporator will tend to drop during the remaining defrost period. At the end of the timer-controlled defrost operation, switch 53 will move to contact 55 and once again energize the compressor 26 and fan 30. As seen in the chart, the line 68 which depicts the temperature line of the present invention terminates the defrost operation by deenergizing the heater at approximately the same time, although at a slightly higher elevated evaporator temperature, than does a temperature sensor located in thermal contact with the evaporator.

It should be apparent to those skilled in the art that the embodiment described heretofore is considered to be presently preferred form of this invention. In accordance with the Patent Statutes, changes may be made in the disclosed apparatus and the manner in which it is used without actually departing from the true spirit and scope of this invention.

What is claimed is:

1. A defrost control for a refrigeration system having means for terminating defrost comprising:

a liner, including plurality walls defining a chamber;

a vertically extending evaporator adjacent one of said walls;

a wall member spaced from said one wall defining an evaporator enclosure, said evaporator enclosure having an inlet opening and an outlet opening spaced from said inlet;

air moving means associated with said enclosure outlet opening for causing circulation of air from said chamber through said heat exchange space inlet and outlets, and back to said chamber;

said evaporator being in abutment with said back wall to thermally link said back wall with the evaporator frost load;

a defrost heater means arranged in said enclosure being positioned between the lower portion of said evaporator and said inlet opening;

air sensing control means being arranged in said heat exchanger space upstream of said evaporator, said control means including a sensing surface being arranged to be within the boundary layer thickness of air passing through said enclosure in natural convection;

switching means responsive to the temperature of said air flow in said boundary layer thickness for terminating said defrost cycle when said air flow in natural convection passing over said evaporator in said boundary layer thickness is substantially at a predetermined evaporator temperature.

2. A defrost control, according to claim 1, in which said liner includes spaced side walls and a back wall, and said wall member is spaced from said back wall and extends between said side walls.

3. A defrost control, according to claim 2, in which said evaporator includes a serpentine tubular member arranged intermediate said openings in said enclosure having spaced turns defining passes extending in the direction of air flow between said openings, said spaced turns being spaced apart so that the connecting tubes therebetween converge toward one another in the direction of said air flow, said evaporator being provided with integral fins having their distal ends in abutment with said back wall.

4. A defrost control for a refrigeration system having means for terminating defrost comprising:

a liner, including spaced side walls and a back wall, defining a freezer chamber;

a vertically extending evaporator adjacent said back wall;

means including a wall member spaced from said back wall defining a heat exchanger enclosure, said evaporator enclosure having an inlet opening and an outlet opening spaced from said inlet;

air moving means arranged in said outlet opening for causing circulation of air from said chamber through said enclosure inlet and outlets, and back to said chamber;

said evaporator comprising a serpentine tubular member arranged intermediate said openings in said enclosure having spaced turns defining passes extending in the direction of air flow between said openings, said spaced turns being spaced apart so that the connecting tubes therebetween converge toward one another in the direction of said air flow, said evaporator being provided with integral fins having their distal ends in abutment with said back wall to thermally link said back wall with the evaporator frost load;

a defrost heater means arranged in said enclosure being positioned between the lower portion of said evaporator and said inlet opening;

air sensing control means being arranged in said heat exchanger space upstream of said evaporator, said control means including a sensing surface being arranged to be within the boundary layer thickness of air passing through said enclosure in natural convection;

switching means responsive to the temperature of said air flow in said boundary layer thickness for terminating said defrost cycle when said air flow passing over evaporator is at a predetermined temperature.

* * * * *